US011117717B2

(12) United States Patent
Chapman et al.

(10) Patent No.: US 11,117,717 B2
(45) Date of Patent: Sep. 14, 2021

(54) CONTAINER LATCHING SYSTEM

(71) Applicants: Dean Chapman, Montclair, NJ (US); John R. Winter, Morristown, NJ (US); Benjamin Broerman, Hoboken, NJ (US)

(72) Inventors: Dean Chapman, Montclair, NJ (US); John R. Winter, Morristown, NJ (US); Benjamin Broerman, Hoboken, NJ (US)

( * ) Notice: Subject to any disclaimer, the term of this patent is extended or adjusted under 35 U.S.C. 154(b) by 176 days.

(21) Appl. No.: 16/694,156

(22) Filed: Nov. 25, 2019

(65) Prior Publication Data

US 2021/0061525 A1 Mar. 4, 2021

Related U.S. Application Data

(60) Provisional application No. 62/892,802, filed on Aug. 28, 2019.

(51) Int. Cl.
*B65D 43/26* (2006.01)
*B65D 43/02* (2006.01)
*B65D 45/18* (2006.01)

(52) U.S. Cl.
CPC ..... *B65D 43/26* (2013.01); *B65D 43/0212* (2013.01); *B65D 45/18* (2013.01); *B65D 2251/20* (2013.01)

(58) Field of Classification Search
CPC ..... B65D 43/26; B65D 43/0212; B65D 2251/20; B65D 45/18
USPC ..... 220/326
See application file for complete search history.

(56) References Cited

U.S. PATENT DOCUMENTS 5,887,745 A * 3/1999 Wood ..... B65D 45/18 220/326
5,957,323 A * 9/1999 Terracciano ..... A47J 36/10 220/574
6,092,687 A * 7/2000 Hupp ..... B65D 1/225 220/666
6,394,299 B1 * 5/2002 Hupp ..... B65D 43/162 220/315
6,554,327 B1 * 4/2003 Riley ..... E05C 1/04 220/326
6,722,520 B2 * 4/2004 Hupp ..... B65D 33/2591 220/315
7,017,776 B1 * 3/2006 Hupp ..... B65D 43/162 220/834
7,490,730 B2 * 2/2009 Cerone ..... B65D 33/2591 220/315

* cited by examiner

*Primary Examiner* — James N Smalley
(74) *Attorney, Agent, or Firm* — Stuart M. Goldstein

(57) ABSTRACT

A container latching system has an open container with a container lid with extended lip sections. Two slide lock latches are located over the lip sections on opposite sides of the lid. With the lid covering the container, the lip sections overlay the top edges of the container, the slide lock latches overlay a portion of the lip sections, and track slider members in each slide lock latch move along the lip sections to lock and seal the lid to the container.

11 Claims, 6 Drawing Sheets

CONTAINER LATCHING SYSTEM

RELATED APPLICATION

This application claims the benefit of provisional application Ser. No. 62/892,802, filed on Aug. 28, 2019.

BACKGROUND OF THE INVENTION

There are numerous containers having lids with lid attachments for storing various items. Many of these containers have been designed for household use, especially for the storage of food where maintaining the freshness of the food within the container is paramount. However, current containers with closure means have significant drawbacks. For instance, the mechanisms for locking many of these containers are overly complicated and subject to breakage and failure. For many users, they are not easy to secure properly and are difficult to confirm that the lid has actually been secured to its container. Other lid to container attachments are simpler, but do not accomplish the objective of providing an air-tight seal for the container.

SUMMARY OF THE INVENTION

It is thus the object of the present invention to provide a container latching system which overcomes the limitations and disadvantages of existing lid to container attachment systems.

This and other objects are accomplished by the present invention, a container latching system comprising an open container having a container lid with extended lip sections. Two slide lock latches are located over the lip sections on opposite sides of the lid. With the lid covering the container, the lip sections overlay the top edges of the container, the slide lock latches overlay a portion of the lip sections, and track slider members in each slide lock latch move along the lip sections to lock and seal the lid to the container.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
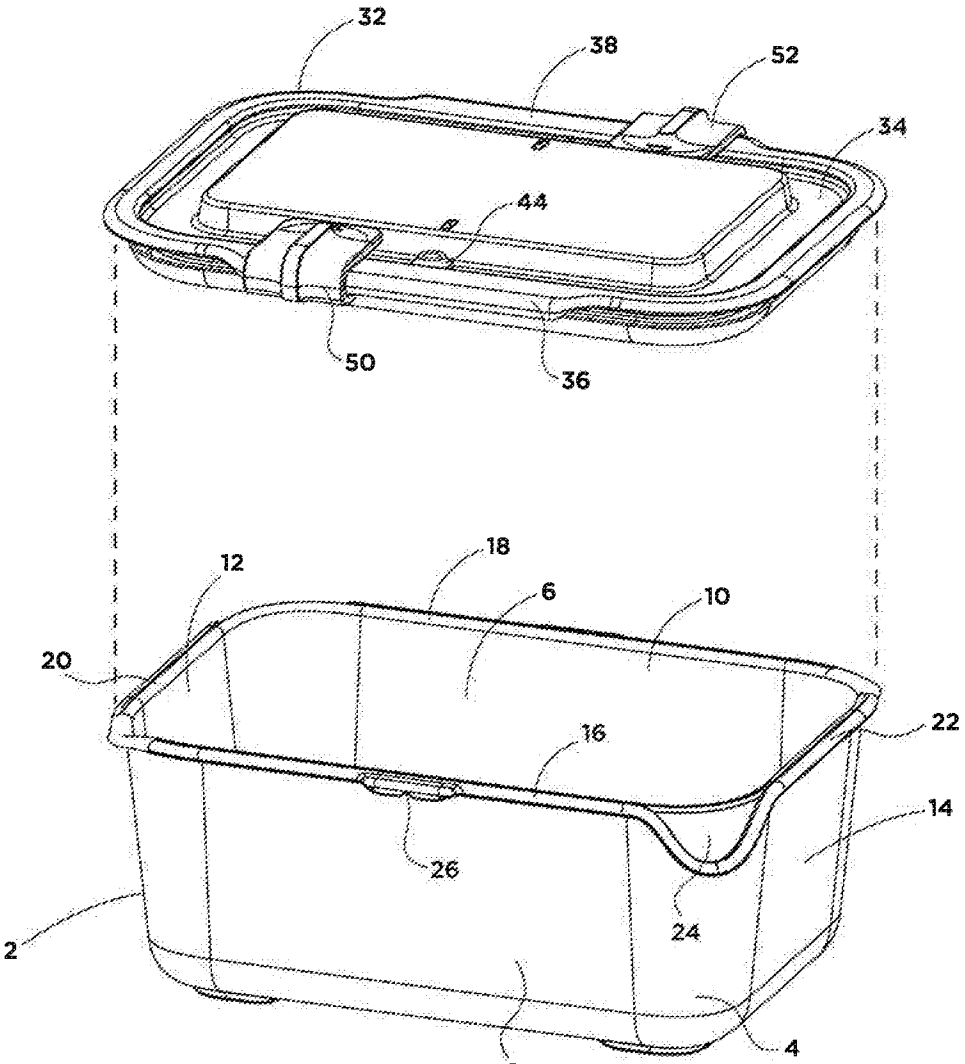
FIG. 1 is a perspective, exploded view of the components of the present invention.

The container locking and sealing system of the present invention comprises container 2, container lid 32, and slide lock latches 50 and 52.

Container 2 comprises main body 4 with open top 6, parallel side walls 8 and 10, and parallel end walls 12 and 14, the walls having top edges 16, 18, 20, and 22 respectively. Container notch 26 is located adjacent to top edge 16 of side wall 8. An identical container notch is inset within top edge 14 of side wall 10. Container 2 also comprises corner spout 24.

Container lid 32 has upper surface 34, It is configured to overlay top edges 16 and 18 of side walls 8 and 10, as well as top edges 20 and 22 of end walls 12 and 14. Lid 32 further has outwardly extending lip sections 36 and 38, extending from side walls 8 and 10, respectively.

Figure 8:
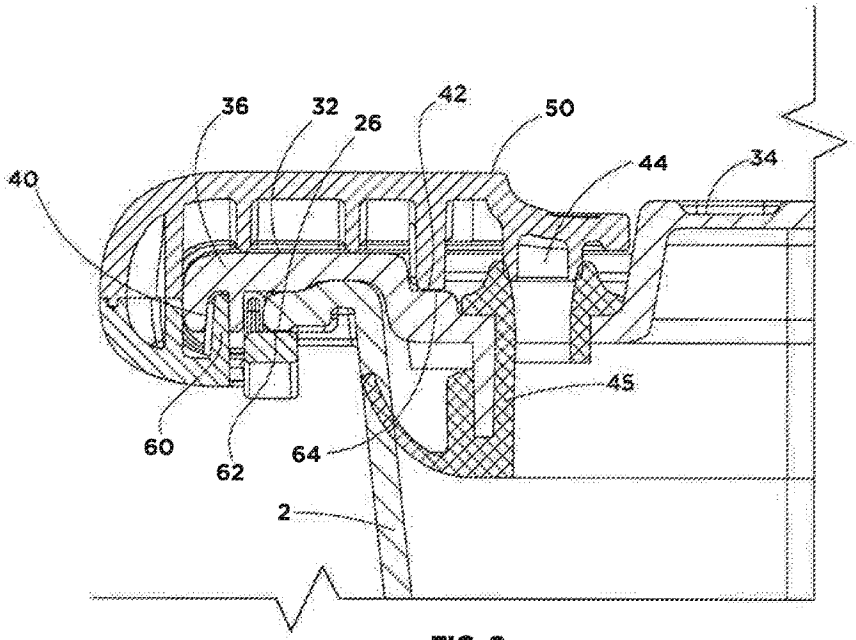
FIG. 8 is a cross-sectional view taken from FIG. 7.
Figure 5:
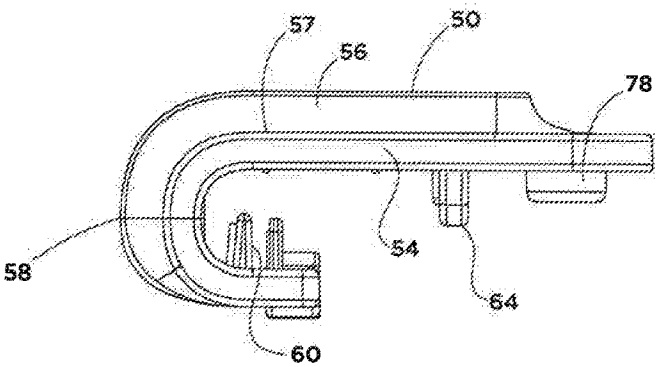
FIG. 5 is an elevation view of the slide lock latch of the present invention.
Figure 7:
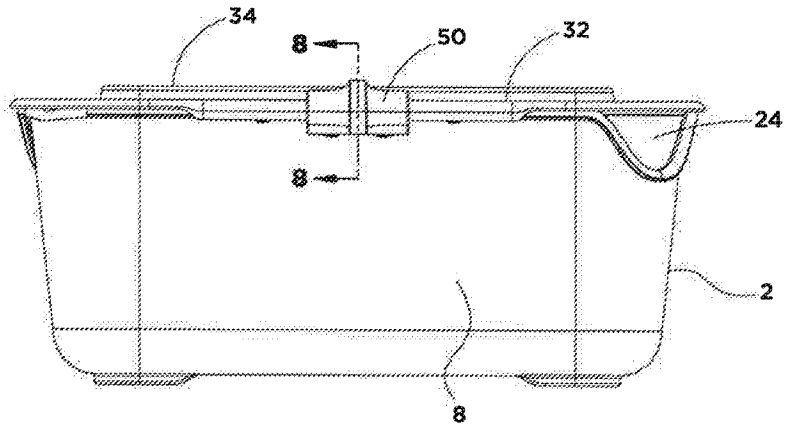
FIG. 7 is an elevation view of the container lid and container of the present invention in its locked position.
Figure 11:
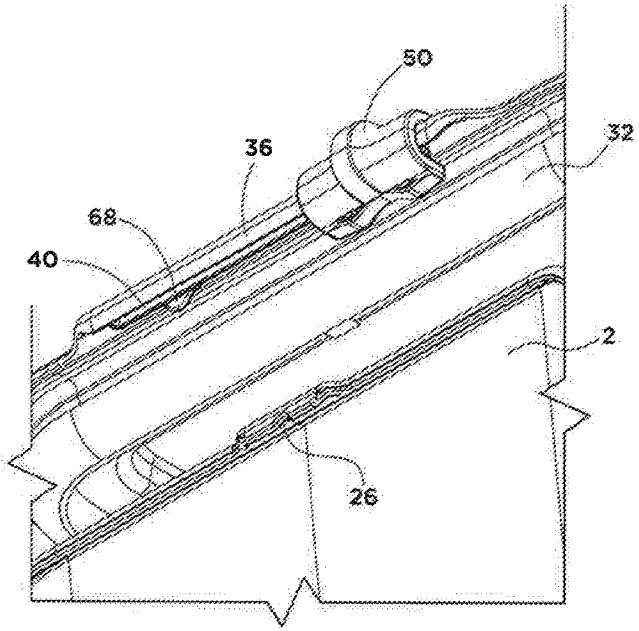
FIGS. 11 and 12 are views of a slide lock latch of the present invention in a container open position with the container lid over the container.
Figure 12:
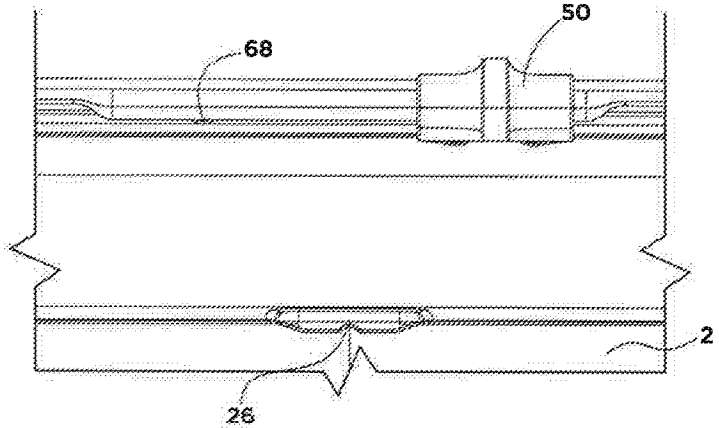

With particular reference to FIG. 8, lip section 36 comprises groove track 40 molded into lid 32. Raised lid pin portion 42 on lid 32 provides a secondary lock for additional attachment between container 2 and the lid, as is more fully described hereinafter. Gasket seal 45 is also provided. Steam vent 44 extends through top surface 34 of lid 32. Lip section 38 extending from side wall 10, has the same configuration as lip section 36, described above.

Figure 4:
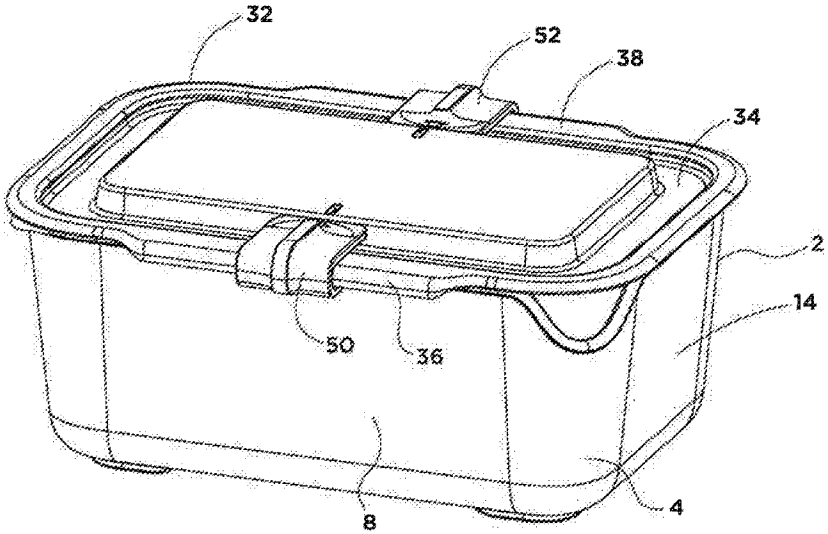
FIG. 4 is a perspective view of the container lid and container of the present invention in locked and sealed position.
Figure 2:
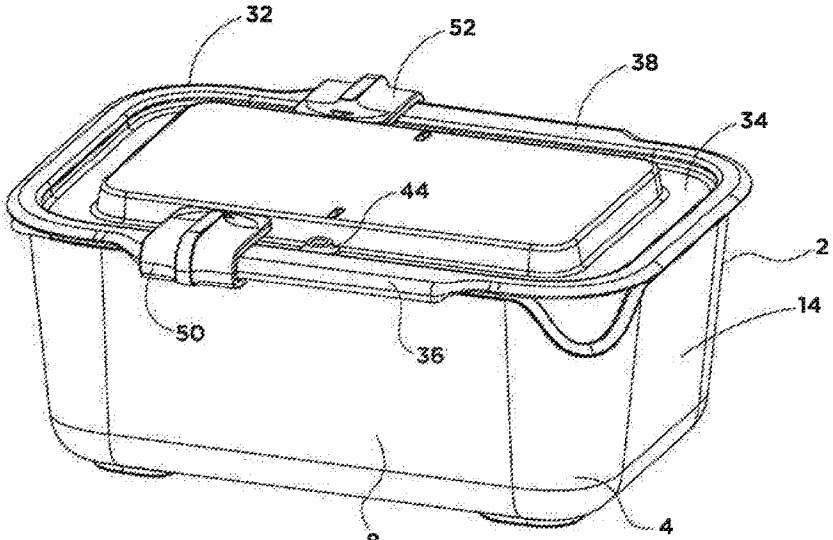
FIGS. 2 and 3 are perspective views of the container lid of the present invention positioned on the container of the present invention in unlocked positions.
Figure 3:
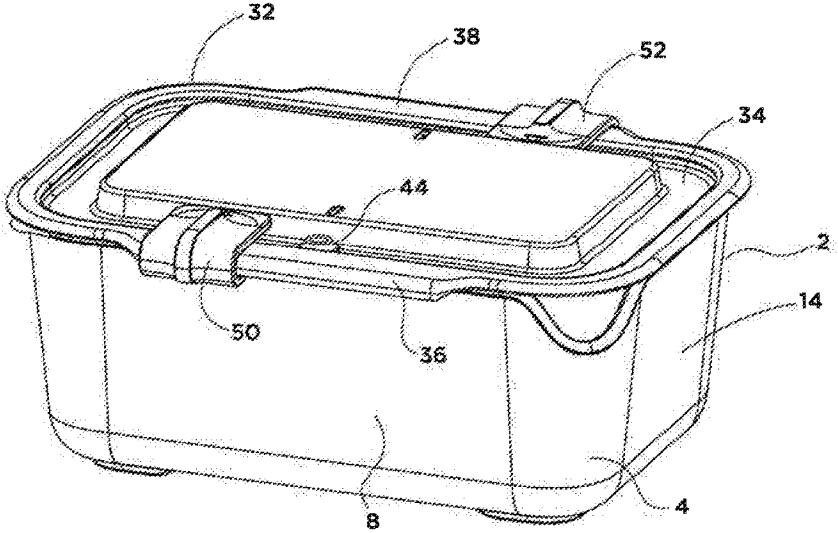
Figure 6:
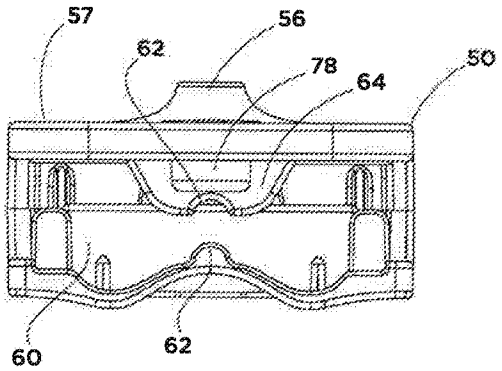
FIG. 6 is the front view of the slide lock latch of the present invention.

Slide lock latches 50 and 52 are designed to overlay and slide along different portions of lip sections 36 and 38, depending on whether container lid 32 is locked onto container 2 (see FIG. 4), whether the container lid is in the process of being removed from the container (see FIGS. 2 and 3), or whether the container lid is actually removed from and lifted off the container (see FIG. 1).

With particular reference to FIGS. 5-8, slide lock latch 50, which is identical to slide lock latch 52, comprises main body 54 having upstanding portion 56, top portion 57, and curved outboard end 58. Track slider means in the form of slider member 60 extends up from and across most of the width of slide lock latch 50. Flexible latch pin 62 extends from the bottom of slide lock latch 50. Secondary locking notch 64 is inset within slider lock latch 50. Steam vent plug 78 extends down from flat portion 57.

In use, container lid 32 is positioned over and covers container 2, lip sections 36 and 38 of the lid overlaying top edges 16 and 18 of side walls 8 and 10. Slide lock latches 50 and 52, in turn, overlay a part of lip sections 36 and 38, such that, with regard specifically to slide lock latch 50 shown in FIG. 8, groove track 40 of lid 32 overlays track slider member 60 of the slide lock latch. This configuration is likewise identical for slide lock latch 52, on the opposite side wall 10.

When slide lock latches 50 and 52 are both moved, by sliding to one side of lip sections 36 and 38 of container lid 32 (see FIGS. 2, 3, 11 and 12) to clear container notch 26, this results in a first or open position in which the container can be removed from and/or placed on the container.

Figure 9:
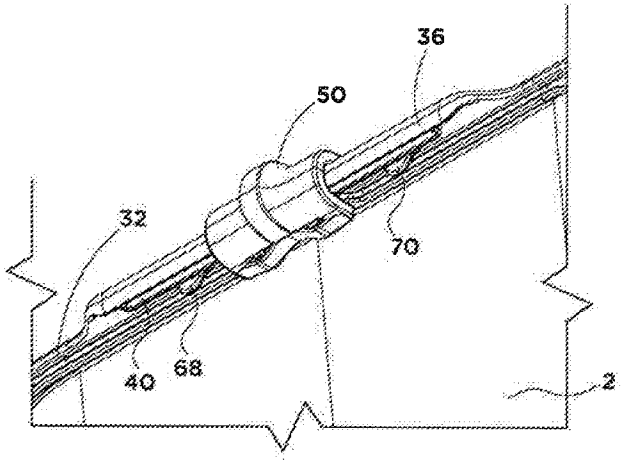
FIGS. 9 and 10 are partial perspective views showing a slide lock latch of the present invention in its locked position.
Figure 10:
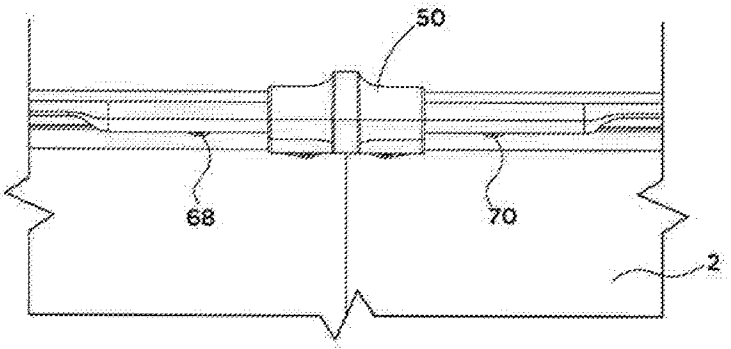
Figure 13:
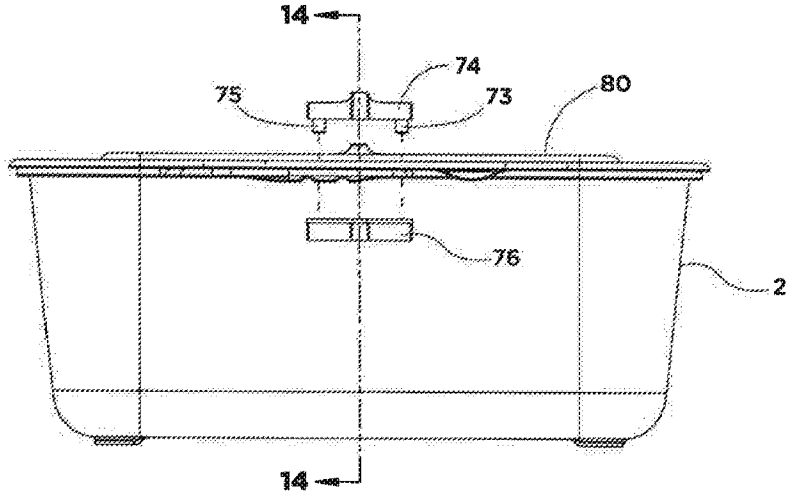
FIG. 13 is an elevation view of an alternative embodiment present invention showing components of alternate slide lock latches.
Figure 14:
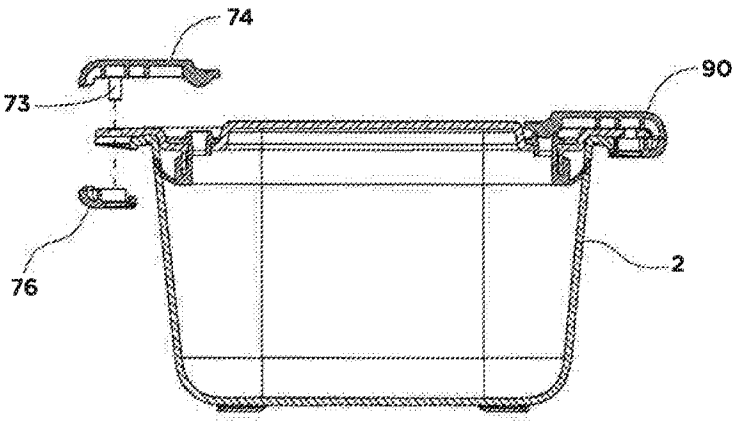
FIG. 14 is a cross-sectional view taken from FIG. 13.
Figure 15:
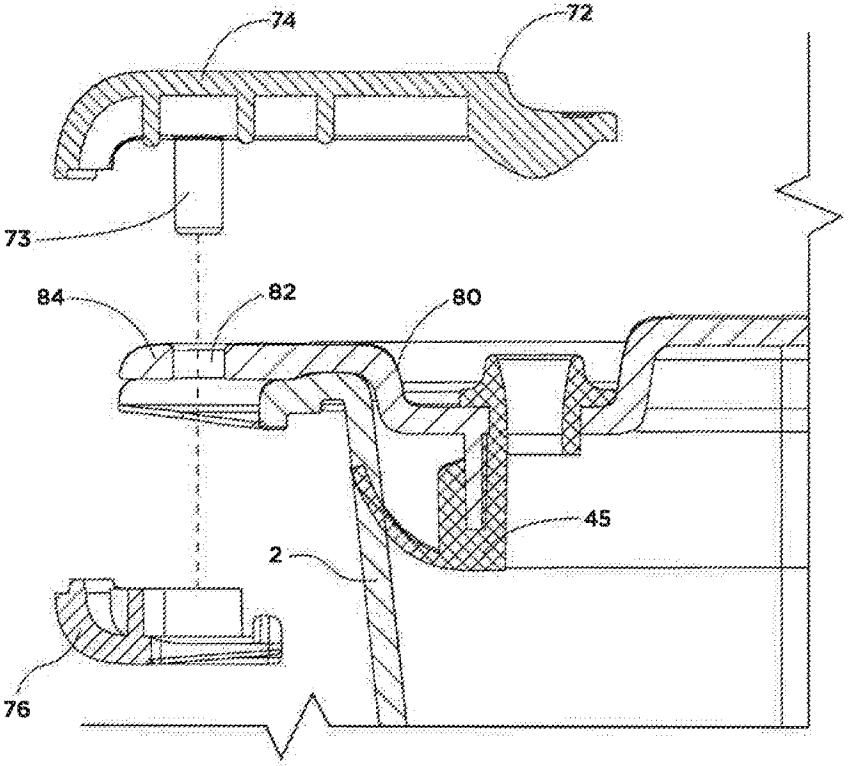
FIG. 15 is a detailed cross-sectional view taken from FIG. 14.
Figure 18:
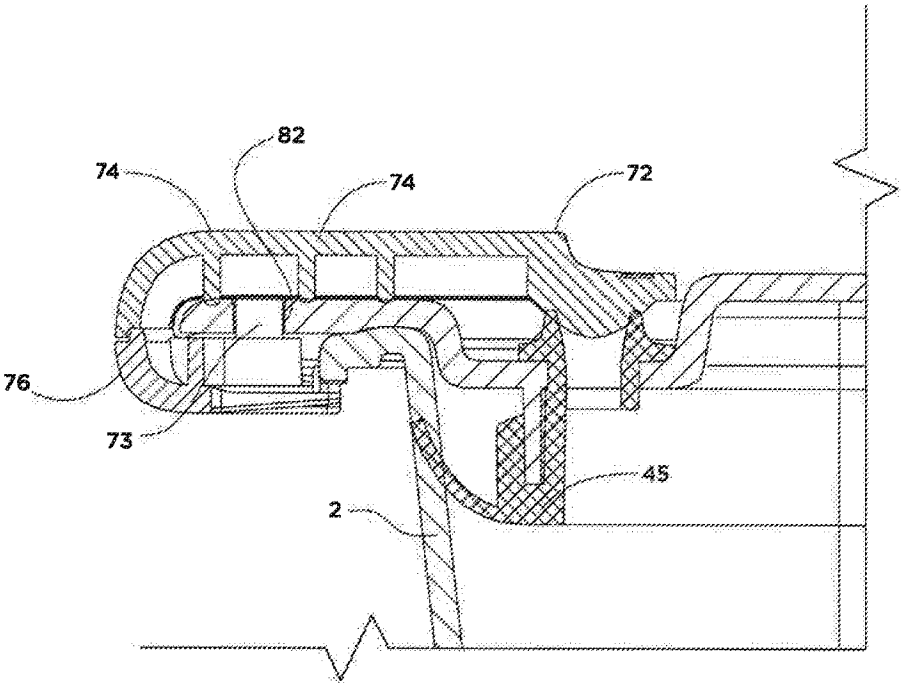
FIG. 18 is a detailed cross-sectional view taken from FIG. 17.
Figure 16:
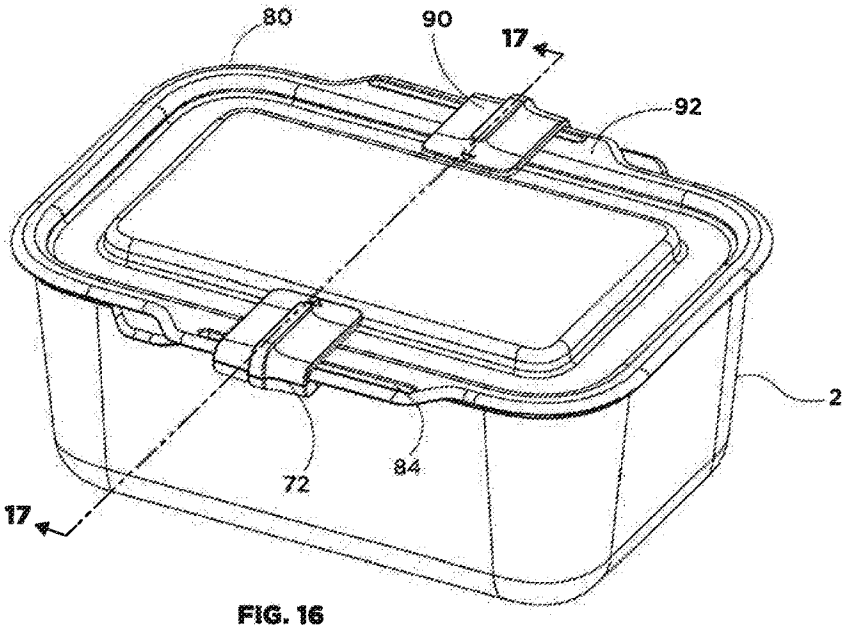
FIG. 16 is a perspective view of the alternate embodiment of the present invention in the locked position.
Figure 17:
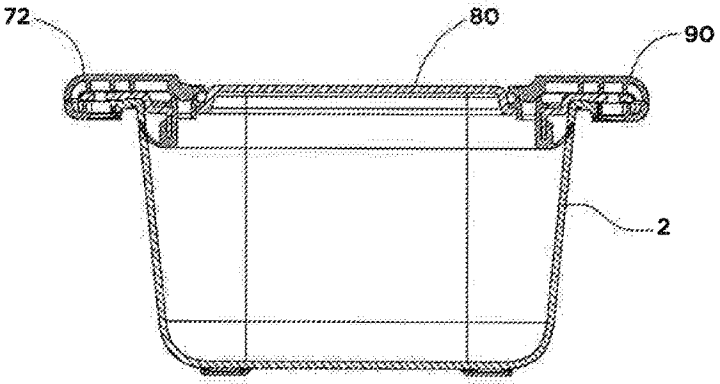
FIG. 17 is a cross-sectional view taken from FIG. 16.

Once container lid 32 is placed on top edges 16 and 18 of side walls 8 and 10 and slide lock latches 50 and 52 are moved by sliding along groove track 40 to the middle of lip portions 36 (see FIGS. 4, 9 and 10), the locking and sealing system of the invention assumes a second or locked position. In this position, latch pin 62 of slide lock latch 50 is positioned within container notch 26 and raised lid pin portion 42 on top surface 34 of lid 32 is inserted into secondary locking notch 64. Container lid 32 is thereby locked and sealed onto container 2.

In this locked position, slide lock latch 50 covers vent 44 by means to vent plug 78. In the open position, in which slide lock latch 50 is slid to the right or to the left of notch 26, vent plug 78 is moved off of and uncovers vent opening 44, to permit any steam in container 2 to escape from the container through the vent.

When slide lock latches 50 and 52 are moved to either side of lip sections 36 and 38, their movement is limited by means of stop tabs 68 and 70 within groove track 40 of lip sections 36 and 38 of container 32, the stop tabs being shown in FIGS. 9-12 with regards to lip section 36.

An alternate embodiment of the invention, shown in FIGS. 13-18, operates in much the same manner as the previously described embodiment, except that the slide lock latch is attached to the container lid. Slide lock latch 72 has top portion 74, bottom portion 76, and track slider means in the form of slider pin members 73 and 75 which extend down from the top portion, Slider pin members 73 and 75 are positioned within groove track 82, formed as a cut through opening in lip section 84 of container lid 80. This permits slide lock latch 72 to be permanently affixed through lid 80 when top portion 74 of the slide latch lock is attached to bottom portion 76 of the slide latch lock. Slide lock latch 90 is identical in configuration to slide lock latch 72 and lip section 92 of container lid 80 is identical in configuration to lip portion 84.

It is contemplated that the slide lock latches can be constructed with a top section and a bottom section and then permanently connected together. The entire slide lock latch can also be fabricated as single unit having a top and bottom interconnected by a hinge which allows the latch to be snapped into place on the container lid.

It is also anticipated that the slide lock latches could be utilized on any side of the container lid from which lip sections extend. It is further contemplated that more than two slide lock latches can be used to lock and seal the container lid onto the container.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A system for locking and sealing a container lid member to a container, said system comprising:

a container comprising two parallel side walls, each side wall having a top edge;

a container lid comprising two outwardly extending lip sections; and a plurality of slide lock latches, each slide lock latch comprising track slider means for moving the plurality of slide lock latches along the lip sections, said track slider means comprising slider pin members which extend downward from each of the plurality of slide lock latches into cut through openings in the lip sections of the container lid and the slide lock latches in order to slide in groove tracks in the lip sections of the container lid, wherein with the container lid covering the container, the lip sections of the container lid overlay the top edges of the container, each of the slide lock latches overlay a portion of the lip sections, and the slider pin members are positioned to slide along the lip sections of the container lid to lock and seal the container lid to the container.

2. The system for locking and sealing a container lid to a container as in claim 1 further comprising a vent extending through the container lid, wherein in the locked position the vent is covered by one of the plurality of slide lock latches and in the open position said slide lock latch is slid off the vent to allow venting of steam from the container.

3. The system for locking and sealing a container lid to a container as in claim 1 wherein the plurality of slide lock latches comprises two slide lock latches.

4. A system for locking and sealing a container lid member to a container, said system comprising:

a container comprising two parallel side walls, each side wall having a top edge;

a container lid comprising two outwardly extending lip sections; and a plurality of slide lock latches, each slide lock latch comprising track slider means for moving the plurality of slide lock latches along the lip sections, said track slider means comprising a slider member which extends upward from each of the slide lock latches and slide in groove tracks in the lip sections of the lid container, wherein with the container lid covering the container, the lip sections of the container lid overlay the top edges of the container, each of the slide lock latches overlay a portion of the lip sections, and the slider member is positioned to slide along the lip sections of the container lid to lock and seal the container lid to the container.

5. The system for locking and sealing a container lid to a container as in claim 4 wherein the plurality of slide lock latches comprise two slide lock latches.

6. The system for locking and sealing a container lid to a container as in claim 4 further comprising a notch inset within the top edges of each side wall and a latch pin extending from each of the plurality of slide lock latches, wherein in a locked position the container lid covers the container and the latch pins of each of the plurality of slide lock latches are positioned in the notches within the top edges of each side wall to lock and seal the container lid to the container, and an open position, the plurality of slide lock latches are slid along the groove tracks such that the latch pins are out of the notches to allow removal of the lid member from the container.

7. The system for locking and sealing a container lid to a container as in claim 6 further comprising a raised portion on each lip section of the lid member and a secondary notch inset within each lip section of the lid member, wherein in the locked position the raised portions are located in a secondary notches, providing a secondary lock to further secure the container lid to the container.

8. The system for locking and sealing a container lid to a container as in claim 4 further comprising a vent extending through the container lid, wherein in the locked position the vent is covered by one of the plurality of slide lock latches and in the open position said slide lock latch is slid off the vent to allow venting of steam from the container.

9. A system for locking and sealing a container lid member to a container, said system comprising:

a container comprising two parallel side walls, each side wall having a top edge;

a container lid comprising two outwardly extending lip sections, each lip section having groove tracks; and a plurality of slide lock latches, each slide lock latch comprising track slider means for moving the plurality of slide lock latches along the lip sections, and stop tabs within each of the lip sections for limiting movement of the plurality of slide lock latches in the groove tracks, wherein with the container lid covering the container, the lip sections of the container lid overlay the top edges of the container, each of the slide lock latches overlay a portion of the lip sections, and the track slider means is positioned to slide along the lip sections of the container lid to lock and seal the container lid to the container.

10. The system for locking and sealing a container lid to a container as in claim 9 wherein the plurality of slide lock latches comprises two slide lock latches.

11. The system for locking and sealing a container lid to a container as in claim 9 further comprising a vent extending through the container lid, wherein in the locked position the vent is covered by one of the plurality of slide lock latches and in the open position said slide lock latch is slid off the vent to allow venting of steam from the container.

* * * * *